US009604093B2

(12) United States Patent
Smyth

(10) Patent No.: US 9,604,093 B2
(45) Date of Patent: Mar. 28, 2017

(54) EXERCISE DEVICE AND METHOD OF USING THE SAME

(71) Applicant: Daniel Smyth, Chatham (CA)

(72) Inventor: Daniel Smyth, Chatham (CA)

(73) Assignee: SMYTH AND HART MEDICAL INNOVATIONS INC., Chatham, Ontario (CA)

( * ) Notice: Subject to any disclaimer, the term of this patent is extended or adjusted under 35 U.S.C. 154(b) by 0 days.

(21) Appl. No.: 13/803,439

(22) Filed: Mar. 14, 2013

(65) Prior Publication Data

US 2014/0005017 A1 Jan. 2, 2014

Related U.S. Application Data

(60) Provisional application No. 61/640,437, filed on Apr. 30, 2012.

(51) Int. Cl.
*A63B 71/00* (2006.01)
*A63B 22/00* (2006.01)
(Continued)

(52) U.S. Cl.
CPC .... *A63B 21/1453* (2013.01); *A63B 21/00185* (2013.01); *A63B 21/068* (2013.01); *A63B 21/151* (2013.01); *A63B 21/4015* (2015.10); *A63B 21/4034* (2015.10); *A63B 21/4039* (2015.10); *A63B 21/4045* (2015.10); *A63B 23/03508* (2013.01); *A63B 23/0405* (2013.01); *A63B 23/0488* (2013.01); *A63B 2208/0233* (2013.01); *A63B 2208/0252* (2013.01)

(58) Field of Classification Search
CPC . A63B 22/00; A63B 22/0076; A63B 22/0079; A63B 22/0082; A63B 22/0084; A63B 22/0087
USPC ..... 482/51, 70, 92, 139
See application file for complete search history.

(56) References Cited

U.S. PATENT DOCUMENTS 1,625,447 A 4/1927 Benice
1,750,549 A * 3/1930 Thomson ..... A63B 22/0076 482/130

(Continued)

FOREIGN PATENT DOCUMENTS

KR 101171881 8/2012
WO WO 2007/070278 A2 6/2007

(Continued)

OTHER PUBLICATIONS

Beaupré Lauren A, Davies, Donna M, Jones, C Allyson and Cinats, John G. "Exercise Combined With Continuous Passive Motion or Slider Board Therapy Compared With Exercise Only: A Randomized Controlled Trial of Patients Following Total Knee Arthroplasty", Physical Therapy, Apr. 2001, vol. 2001, No. 4, pp. 1029-1037.

(Continued)

*Primary Examiner* — Stephen Crow
*Assistant Examiner* — Garrett Atkinson

(57) ABSTRACT

An exercise device may comprise first and second elongated support members, at least one brace member for holding the first and second support members in a spaced apart relation to each other and a limb support device being disposed between the first and second support members and being interconnected thereto for sliding longitudinal relative to the first and second support members.

24 Claims, 11 Drawing Sheets

(51) Int. Cl.

| | |
|---|---|
| ***A63B 21/00*** | (2006.01) |
| ***A63B 21/068*** | (2006.01) |
| ***A63B 23/035*** | (2006.01) |
| ***A63B 23/04*** | (2006.01) |

(56) References Cited

U.S. PATENT DOCUMENTS

| | | | | |
|---|---|---|---|---|
| D87,261 | S | 6/1932 | Hardy et al. | |
| D118,847 | S | 2/1940 | Wright | |
| D193,435 | S | 8/1962 | Weiss | |
| 3,467,376 | A | 9/1965 | Feinberg | |
| D203,123 | S | 12/1965 | Spackman, Jr. et al. | |
| 3,559,986 | A * | 2/1971 | Ehrmantraut | A63B 23/0417 482/132 |
| 3,620,530 | A * | 11/1971 | Cosby | A63B 21/0552 482/130 |
| 3,658,327 | A | 4/1972 | Thiede | |
| D225,343 | S | 12/1972 | Flick et al. | |
| D268,277 | S | 3/1983 | Smith | |
| 4,402,506 | A | 9/1983 | Jones | |
| 4,474,378 | A * | 10/1984 | Dwyer | A63B 21/0023 473/229 |
| 4,512,571 | A * | 4/1985 | Hermelin | A63B 22/0007 482/132 |
| 4,535,985 | A * | 8/1985 | Mask | A63B 21/4029 482/138 |
| 4,629,181 | A * | 12/1986 | Krive | A63B 69/18 482/146 |
| D289,539 | S | 4/1987 | Brentham | |
| 4,684,121 | A | 8/1987 | Nestegard | |
| 4,743,015 | A * | 5/1988 | Marshall | A63B 21/00072 482/112 |
| 4,813,667 | A | 3/1989 | Watterson | |
| 4,848,737 | A | 7/1989 | Ehrenfield | |
| 4,921,242 | A | 5/1990 | Watterson | |
| 4,971,315 | A * | 11/1990 | Rector | A63B 5/10 114/343 |
| D314,027 | S | 1/1991 | Lo | |
| 5,145,481 | A | 9/1992 | Friedebach | |
| 5,279,530 | A | 1/1994 | Hess | |
| 5,499,958 | A | 3/1996 | Hess | |
| 5,503,609 | A * | 4/1996 | Bull | A63B 21/154 482/51 |
| 5,518,483 | A | 5/1996 | Oswald | |
| 5,518,484 | A | 5/1996 | Bruckenstein | |
| D403,163 | S | 12/1998 | Lipps | |
| D419,625 | S | 1/2000 | Barnett | |
| 6,013,010 | A | 1/2000 | Farsaie | |
| D425,585 | S | 5/2000 | Wu | |
| D483,082 | S | 12/2003 | Toole | |
| 7,294,100 | B2 * | 11/2007 | Bull | A63B 23/03541 482/51 |
| D622,787 | S | 8/2010 | Masterson | |
| D623,244 | S | 9/2010 | Hoffman | |
| D630,275 | S | 1/2011 | Mills et al. | |
| 7,892,073 | B1 | 2/2011 | Smania et al. | |
| 7,931,570 | B2 * | 4/2011 | Hoffman | A63B 21/055 482/123 |
| 7,951,050 | B2 | 5/2011 | Raumann et al. | |
| 8,033,971 | B2 | 10/2011 | Campanaro et al. | |
| 8,142,336 | B1 | 3/2012 | Yates | |
| 2001/0036885 | A1 | 11/2001 | Castellot et al. | |
| 2004/0043876 | A1 | 3/2004 | Craciunescu | |
| 2005/0113227 | A1 * | 5/2005 | Endelman | A63B 21/04 482/142 |
| 2005/0181914 | A1 | 8/2005 | Radkowski et al. | |
| 2005/0245148 | A1 * | 11/2005 | Mun | A63B 31/11 441/64 |
| 2009/0098983 | A1 | 4/2009 | Hoffman | |
| 2009/0098988 | A1 | 4/2009 | Kennedy | |
| 2009/0105050 | A1 * | 4/2009 | Mayo | A63B 21/00192 482/70 |
| 2010/0016131 | A1 | 1/2010 | Hoffman | |
| 2010/0311555 | A1 | 12/2010 | Campanaro et al. | |
| 2011/0118094 | A1 | 5/2011 | Kissner et al. | |
| 2012/0108405 | A1 | 5/2012 | Milo | |
| 2012/0244998 | A1 * | 9/2012 | Rao | A63B 71/0054 482/70 |

FOREIGN PATENT DOCUMENTS

| | | | |
|---|---|---|---|
| WO | WO 2010/139015 | A1 | 12/2010 |
| WO | WO 2013/009577 | A1 | 1/2013 |

OTHER PUBLICATIONS

International Search Report for PCT International Application No. PCT/CA2013/050327, filed Apr. 29, 2013.

Written Opinion for PCT International Application No. PCT/CA2013/050327, filed Apr. 29, 2013.

"POP—Post-Operative Knee Exercise Board", catalogue extract, p. 58, (date unknown).

OrthoCanada POP—Post-Operative Knee Exercise Board Product Sheet, (date unknown).

OrthoCanada POP—Post-Operative Knee Exercise Board—2010 APTA—CSM Special Promotion Flyer (date unknown).

* cited by examiner

EXERCISE DEVICE AND METHOD OF USING THE SAME

CROSS-REFERENCE TO RELATED APPLICATION

This application claims priority from U.S. provisional application No. 61/640,437, filed Apr. 30, 2012, the contents of which are hereby incorporated herein by reference.

FIELD OF THE INVENTION

The present invention relates generally to exercise devices and methods of using the same.

BACKGROUND OF THE INVENTION

Exercise devices of various kinds are well known. Some exercise devices are used simply for exercising. However, some exercise devices are particularly useful for assisting in the rehabilitation of limbs including legs and associated joints. An improved, versatile and easily transportable exercise device is desired.

SUMMARY OF THE INVENTION

According to one aspect of the present invention there is provided an exercise device, comprising: (a) first and second elongated support members; (b) at least one brace member for holding the first and second support members in a spaced apart relation to each other; (c) a limb support device being generally located between the first and second support members and being interconnected thereto for sliding longitudinal movement relative to the first and second support members; the first and second elongated support members and the limb support device being configured with a sliding groove connection, the sliding groove connection comprising: (i) a pair of elongated grooves on either the elongated support members or limb support device; (ii) a sliding protrusion element received in each of said elongated sliding grooves, on the other of the elongated support members or limb support device; such that said limb support device is operable to be supported by the sliding groove connection and the limb support device is operable for sliding elongated movement relative to the first and second said support members.

According to another aspect of the present invention there is provided an exercise device, comprising: first and second elongated support members; at least one brace member for holding the first and second support members in a spaced apart relation to each other; a limb support device being disposed between the first and second support members and being interconnected thereto for sliding longitudinal relative to the first and second support members.

According to another aspect of the present invention there is provided an exercise device, comprising: first and second elongated support members; at least one brace member for holding the first and second support members in a spaced apart relation to each other; a limb support device being disposed between the first and second support members and being interconnected thereto for sliding longitudinal relative to the first and second support members; the first and second elongated support members are each configured an elongated sliding groove, and wherein the limb support device has portions receivable in each of the elongated sliding grooves, such that the limb support device is operable to be supported by the sliding grooves and the limb support device is operable for sliding elongated movement in the sliding grooves relative to first and second the support members; wherein the first and second support members have a strengthening device integrated therein.

BRIEF DESCRIPTION OF THE DRAWINGS

In the figures which illustrate by way of example only, embodiments of the present invention.

DETAILED DESCRIPTION

Figure 1:
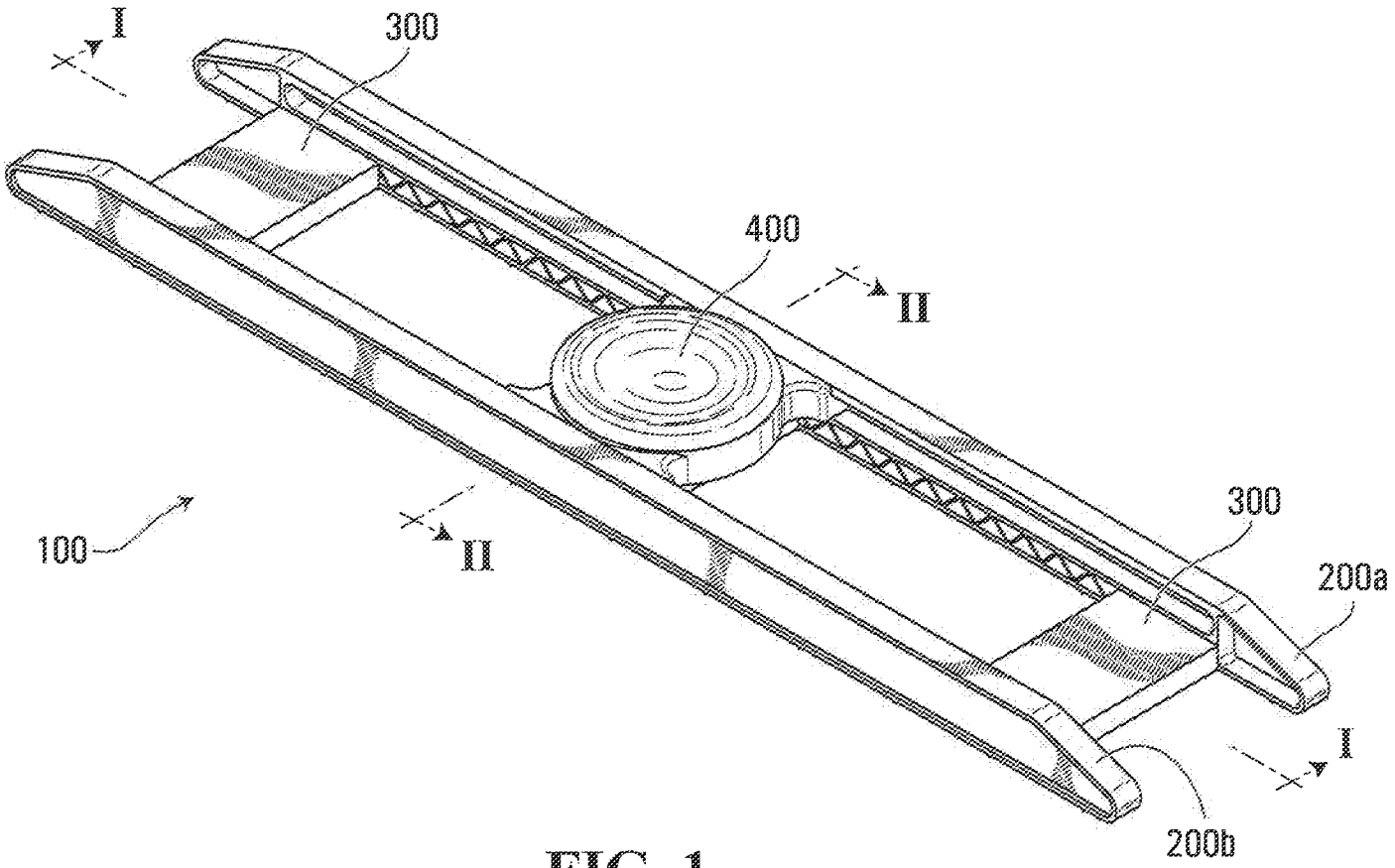
FIG. 1 is a right side perspective view of a device; the left side perspective view is a mirror image.
Figure 2:
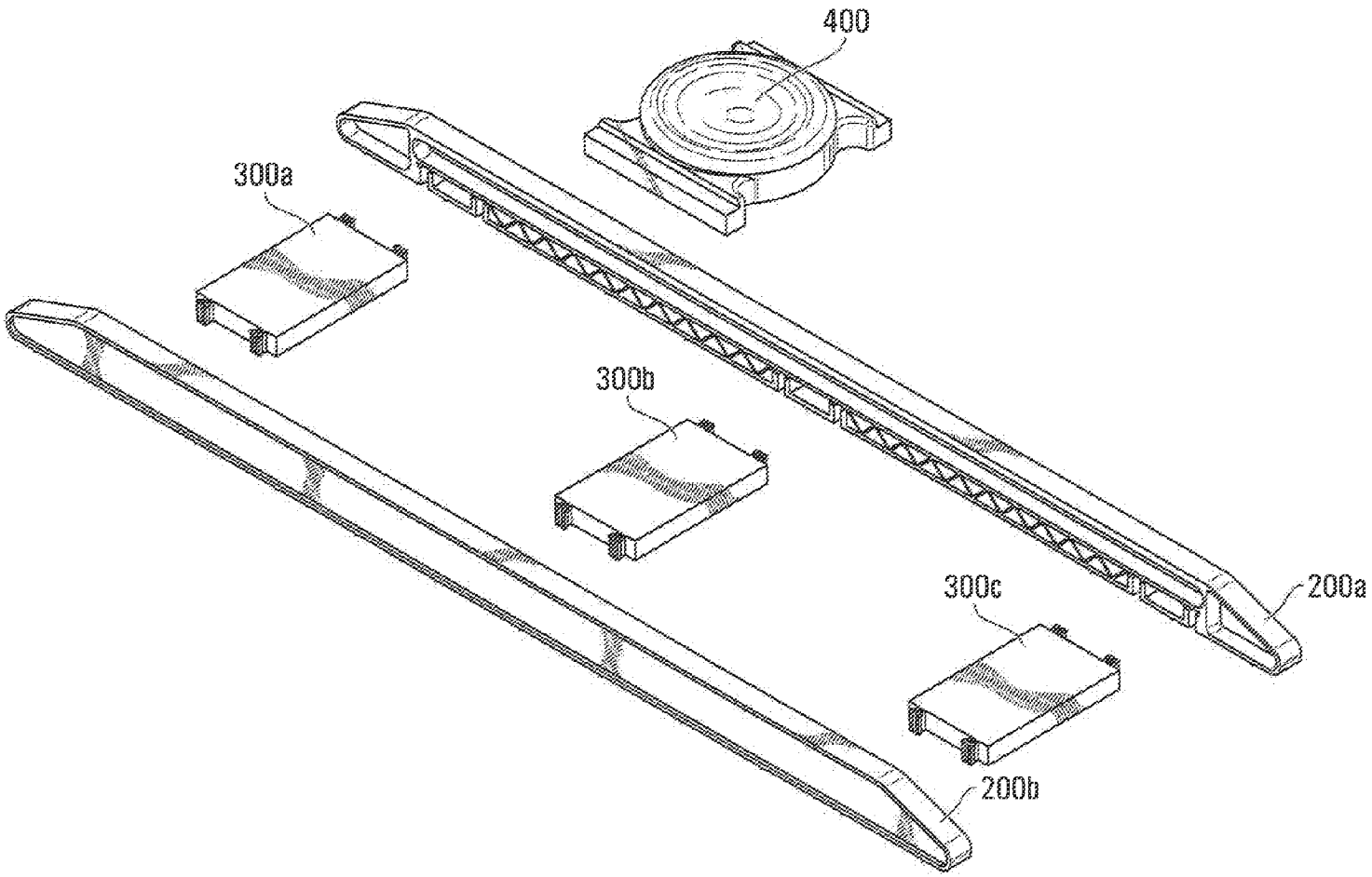
FIG. 2 is a right side exploded perspective view of the device of FIG. 1.

With reference to FIGS. 1 and 2 exercise device 100 may comprise two elongated support members 200*a*, 200*b*, interconnected to each other by one or more spaced lateral brace members 300*a*, 300*b*, and 300*c*. Exercise device 100 may also include a limb support device 400 that may be configured as a heel support. For example, heel support may be a heel cup device 400 as shown in FIGS. 1 and 2. The support members 200*a*, 200*b* may be generally straight and may be arranged in a generally spaced parallel relation to each other. Support members may be rigidly and fixedly held in such configuration by spaced brace members 300*a-c* that extend laterally between the longitudinally extending support members 200*a*, 200*b*. The heel cup 400 may be configured to be held between support members 200*a*, 200*b*. Heel cup 400 may be capable of sliding back and forth in longitudinal movement relative to the support members 200*a*, 200*b*. In the embodiment illustrated in FIGS. 1 and 2, heel cup 400 moves longitudinally above brace members 300*a-c*.

FIG. 2 shows the main components that may comprise exercise device 100 in a disassembled configuration with the components exploded apart. Generally one or more brace members 300*a-c* may be used to fixedly secure the support members in spaced parallel relation to each other. In this embodiment, three braces 300*a*, 300*b* and 300*c* are used.

Figure 3:
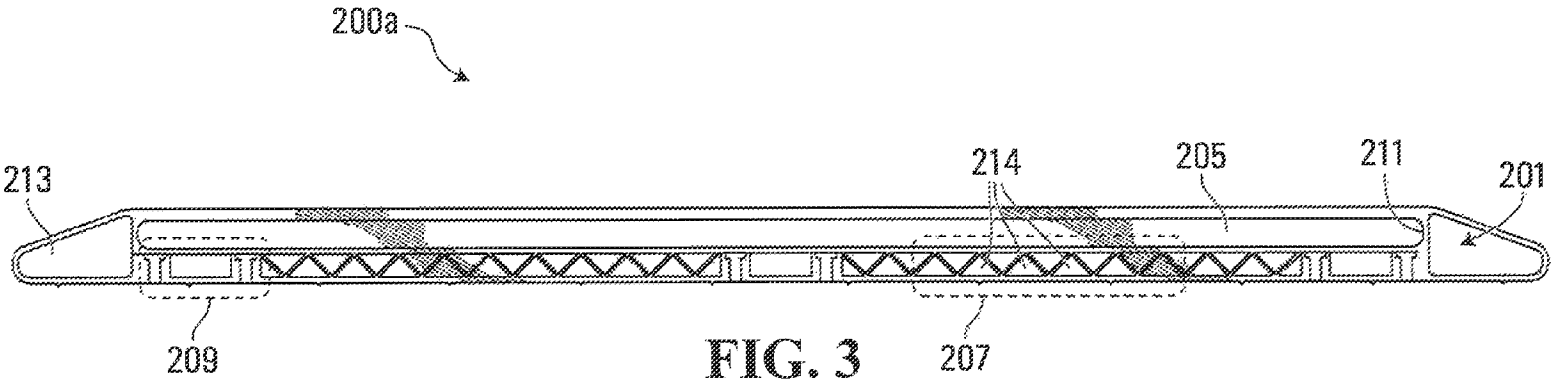
FIG. 3 is right side elevation view of part of the device in FIG. 1.

FIG. 3 shows the interior side surface 201 of the support rail 200*a*. The opposite inner surface of support rail 200*b* may be constructed in the same manner. Support members 200*a*, 200*b* may be made from a wide range of materials, such as wood, metals such as aluminum, suitable plastics, carbon fibre, metals such as stainless steel, or suitable composite materials. Generally, the desired materials may be impact resistant and would able to provide a relatively high degree of strength and stiffness with a relatively low weight/density. In one preferred embodiment, the support members 200*a*, 200*b* may be injection-molded as a single contiguous piece using for example Nylenium® 2800ST S, polycarbonates, nylon, acrylics or acrylonitrile butadiene styrene ("ABS"). In some embodiments the support members 200*a*, 200*b* may be made by conventional injection molding manufacturing techniques.

One or both ends 213 of each support member 200*a*, 200*b* may be tapered on an upper and/or lower surface to provide a narrower tip portion. This tapering of ends 213 may make it more comfortable to juxtapose the ends of the exercise device 100 next to a body part of a user of the device, such as the underside of an individual's thigh. The increased comfort is particularly noticeable when a patient's body part, such as the thigh, is intended to fold over or make an acute angle with the support members 200*a*, 200*b*. This, for example, would be the case in the method of exercising depicted in FIG. 15 which is described below.

A sliding groove connection may be provided between the elongated support members 200*a*, 200*b*, and the limb support device 400 that allows the limb support device to slide relative to the support members. The sliding groove connection may for example be any combination of: (i) one or more grooves on either the support members or on the limb support device; and (ii) one or more protrusion elements of some kind that are at least partially received in each of the one or more grooves. For example, the sliding groove connection may include a longitudinally extending slot or sliding groove 205 that may be provided in inner surface 201 of each support member 200*a*, 200*b*. An opposed pair of grooves 205 may be integrally formed into the inner side surfaces 201 of each support member 200*a*, 200*b* and be positioned at substantially the same vertical height as each other. The sliding grooves 205 may be defined by upper, lower and one or more side surface walls or plates defining a cavity with a constant cross-section extending longitudinally along the support members 200*a*, 200*b*. The cavity will have an opening for receiving some kind of sliding protrusion element. In the depicted embodiment, the cavity of the groove 205 has a constant rectangular cross-section. The opposed grooves 205 provide a path along which each protusion element (that may be at a side edge of the heel cup 400) can slide back and forth. Grooves 205 may be made of or lined with a material of high hardness, high impact and high wear resistance to minimize wear as the heel cup 400 repeatedly slides back and forth along the grooves of support members 200*a*, 200*b*. Grooves 205 may be shorter than the length of the support member 200 terminating in groove ends 211. The groove ends may function to prevent the heel cup 400 from sliding out of grooves 205.

In order to achieve a strong and stiff but preferably also relatively light-weight construction, a strengthening device may be provided for each of support members 200*a*, 200*b*. A wide variety of strengthening mechanisms may be deployed that may strengthen the support members 200*a*, 200*b* as a whole, as well as provided specific strengthening of the portions that are adjacent to the grooves 205 which may be relatively weak locations in the support members. The strengthening device in each support member 200*a*, 200*b* may be provided as a parallel support groove or slot 306 may be defined by upper, lower and one or more side surface walls or plates defining a cavity with a constant cross-section extending longitudinally along the support members 200*a*, 200*b*. Grooves 306 may extend substantially co-extensively with grooves 205, either above or below the groove 205 with a structural support device that may include several structural support elements extending between the top and bottom surface walls of groove 306. Preferably grooves 205 have bottom wall plates which also form the top wall plates of grooves 306. While the support elements may be generally vertically oriented support members, a particularly useful strengthening device that may be provided in groove 306 is a support truss 207 provided within the groove 306. Support truss 207 may be made from one or more separate components forming the members of the truss and the top plate of the truss may be the top wall of the groove 306. Alternatively truss members may be formed integrally with other portions of support member 200*a*, 200*b* and may be provided with additional elements to form the truss. Truss 207 may be formed in any one of a number of known truss configurations. For example, as shown in the FIGS. 1, 2, 3 and 14, truss 207 may be formed with a "zig-zag" arrangement of plate like ribs 214 that form generally triangular shaped truss sections. Other known configurations of ribs that provides stiffness or otherwise strengthens the support member 200*a*, 200*b* may be provided. Truss 207 may not only provide strength for the support members 200*a*, 200*b* as a whole, but in some embodiments, truss may specifically be positioned to strengthen the bottom surface wall of grooves 205, to provide reinforcement in that area due to variable increased loads resulting from a heel cup 400 loaded with a peron's leg traversing across during sliding movement. It will be appreciated that a significant load may be applied particularly to the bottom surface wall of groove 205 due the weight of a limb positioned on heel cup 400 in use. The strengthening provided by truss 207 in groove 306 may not be at the expense of a large increase in weight to each support member 200*a*, 200*b*.

Some other alternatives to truss 207 which may still provide efficient strengthening of the support devices 200*a*, 200*b*, and may, in particular increase strength for support in grooves 306, while maintaining a relatively reduced weight of each support member 200*a*, 200*b*, include other devices known in structural engineering. For example, there may be provided in groove 306 a longitudinally extending beam member, such as for example an I-beam member where the upper and lower flanges would extend longitudinally in the groove 306, which may be located below groove 305. Truss 207 may be interrupted by one or more brace member attachment sites 209. Brace attachment sites 209 may be cavities adapted to receive parts of the brace 300, or otherwise adapted to be attached to the brace using any other methods known in the art, such as for example with screws, bolts/nuts, or welding.

Figure 4:
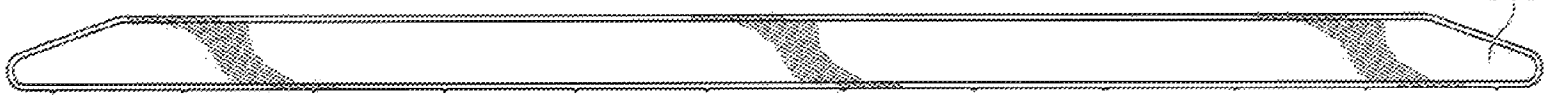
FIG. 4 is a right side elevation of the device of FIG. 1.

FIG. 4 shows the outer side 203 of the support member 200. Outer side 203 may be flat thereby concealing from at least some views the groove 205, truss 207, and brace attachment sites 209.

Figure 6:
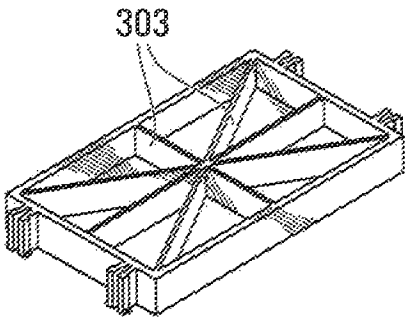
FIG. 6 is a lower perspective view of the part shown in FIG. 5.
Figure 5:
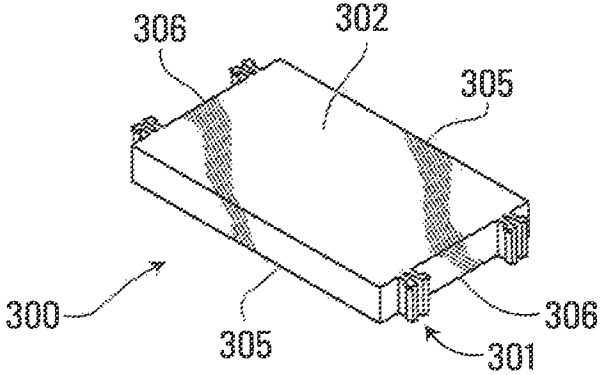
FIG. 5 is an upper perspective view of another part of the device of FIG. 1 shown in isolation.
Figure 8:
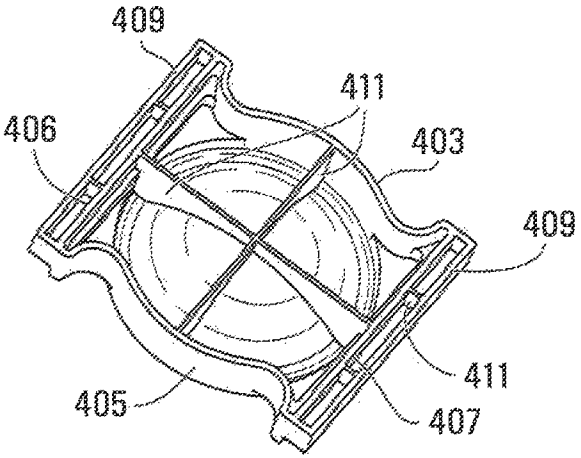
FIG. 8 is a lower perspective view of the part shown in FIG. 7.
Figure 10:
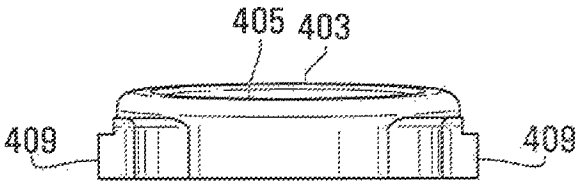
FIG. 10 is a front elevation view of the part of FIG. 7.

FIGS. 5 and 6 show an embodiment of brace members 00*a-c* used to join the support members 200. The brace members 300*a-c* may be made from a wide variety of materials including for example, certain woods, metals such as aluminum, plastics, carbon fibre, metals such as stainless steel, or other composite materials. Generally, the desired materials would be impact resistant and able to provide high stiffness at a relatively low weight. In this embodiment brace member 300 is generally rectangular in cross section and cuboid in shape. Like support members 200*a*, 200*b*, brace members 300*a-c* may also be injection-molded as a single contiguous piece using similar materials to support members 200*a*, 200*b*. In some embodiments, support members 200*a*, 200*b*, and brace members 300*a-c* may be provided as one integrally formed piece of material such as from a suitable injection-molded plastic.

Brace members 300*a-c* may have a generally hollow interior cavity beneath a top plate 302 and side walls 305, 306. The interior cavity may be provided with ribs 303 that may be integrally formed with top plate 302 and side walls 305, 306 of the brace members 300*a-c* to increase stiffness while keeping the weight relatively low. The ribs 303 may be arranged in any configuration that would achieve high stiffness at a reduced weight. Attachment protrusion elements 301 may be integrally formed as part of the brace members 300*a-c*. The attachment protrusion elements 301 may mate with brace attachment sites 209 of the support members 200. These protrusion elements may be snap pieces, pegs, or other resiliently displaceable protrusions adapted to fit/plug into co-operative slots in the brace attachment sites 209. The brace members 300*a-c* may thus be attached to the support members using snap pieces, glued tongue and groove mating pieces, or any other method known in the art that would provide a stiff and durable attachment. However, although not preferred, in some embodiments, this attachment may be readily releasable. In some embodiments, brace members 300*a-c* may be connected to support members 200*a*, 200*b* with screws, nut/bolts, welding or other known attachment techniques and mechanisms to provide for a relatively strong connection.

Turning now to FIGS. 7-12, heel cup 400 is illustrated in further detail. Heel cup 400 may be made from a wide variety of materials including wood, metals such as aluminum, suitable plastics, carbon fibre, metals such as stainless steel, or suitable composite materials. Generally, the desired materials would be hard and impact resistant and able to provide high stiffness at a relatively low weight. The heel cup 400 may also be injection-molded as a single contiguous piece using for example one or more of the same materials as support members 200*a*, 200*b* and/or brace members 300*a-c* and using conventional injection molding manufacturing techniques. However, if heel cup 400 is configured to slide with direct contact between the heel cup and the material from which the support member (and in particular the inner surfaces of groove 205) is made, these materials need to be chosen to ensure that the heel cup can easily slide without much frictional resistance. It should be noted that it is not intended that there be a significant degree of resistance to sliding movement of the heel cup 400 imparted by the interconnection between the cup 400 and the groove 205. To minimize the cost of production of device 100, it is preferred that there be no additional devices employed in groove 205 to enhance the sliding movement (ie. reduce frictional resistance) but it would be possible to provide certain friction reducing mechanisms such as for example, a rail and ball bearing system between the groove 205 and heel cup 400 on both support members 200*a*, 200*b*.

Continuing with reference to FIGS. 7 to 12, heel cup 400 may be formed with an upper generally circular or elliptical plate 416 connected at its periphery with downwardly depending arcuate front and rear wall portions 403, 405, that extend between generally straight, parallel side wall portions 406, 407. Plate 416, walls 403, 405 and walls 406, 407 may define a generally hollow interior space. The cup 400 may also be strengthened with support ribs 411 to increase stiffness while keeping the weight low. The ribs 411 may be integrally formed and may be arranged in any configuration that is known in the art to achieve high stiffness at minimum weight. Heel cup 400 may be comprised of a depression 401 in circular plate 416, which is attached at two opposing sides to two generally rectangular shaped sliding blocks/tongues 409 that are on their upper and outer side surfaces generally rectangular shaped and longitudinally extending. Tongues 409 thus may form sliding protrusion elements for being received and held in sliding grooves 205. Tongues 409 may be attached to the circular plate 416 portion of heel cup 400 with an intermediate portion 407. Intermediate portion 407 may be integrally-formed with the plate 416 and the tongues 409. The depression 401 may be hemispherical or of any other shape suitable to receive a heel of a human foot. Some embodiments of device 100 may have depressions sized for larger feet; some for smaller feet. The depression 401 has a circumferential opening lip 413. Lip 413 may be rounded or beveled to increase comfort when the foot comes into contact with the lip 413. The increased comfort will be particularly noticeable when a human heel is placed in the depression 401 so that the shin bone makes an acute angle with the plane on which the exercise device 100 rests and the Achilles tendon stretches over the lip 413.

Optionally, the depression 401 may have diametrically opposing front and rear side walls 405 and 403 of differing heights and configurations. Front wall 405 may be shorter than rear wall 403 to increase comfort when the heel is placed in the depression 401. The increased comfort will be particularly noticeable when the heel is placed in the depression 401 so that the shin bone makes an acute angle with support members 200 and the Achilles tendon stretches over the side wall 405.

Moreover, the depression 401 and the lip 413 may be lined with a soft material such as an elastomer, various types of foamed materials or cotton materials, a foamed plastic, felt, or suede or any other materials that may increase comfort. In an alternative embodiment, not depicted, the depression 401 and the lip 413 may be made from a different material than the tongues 409 and intermediate piece 407. The depression 401 and the lip 413 may be made from an elastic material such as an elastomer such as natural polyisoprene, polybutadiene, butyl rubber, silicone rubber, ethylene propylene or another suitable rubber. The depression 401 may be made from cloth and/or may include straps defining a harness for the heel of the foot.

Tongues 409 may have a cross section that is sized and shaped to fit closely in the grooves 205, but allows the free movement of the tongue 409 along the groove 205. The fit of the tongues 409 in the grooves 205 should be close enough to minimize any movement of the tongues in the grooves other than free movement in the longitudinal direction along the length of the grooves. The tongues 409 can be made from a material with high hardness and stiffness, such as metals such as stainless steel, metal alloys, plastics, hard wood, fiberglass, or other various composite materials. The tongues 409 may be formed integrally as part of the overall cup 400. The heel cup's tongues 409 and the support members' grooves 205 can be made from materials of comparable hardness to minimize material wear between tongues 409 and grooves 205, but permit suitable sliding without undue force being necessary to overcome friction.

Figure 7:
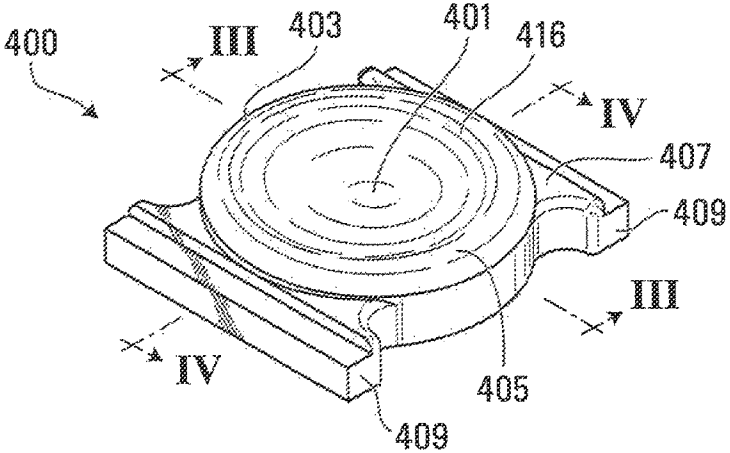
FIG. 7 is an upper perspective view of another part of the device of FIG. 1 shown in isolation.
Figure 9:
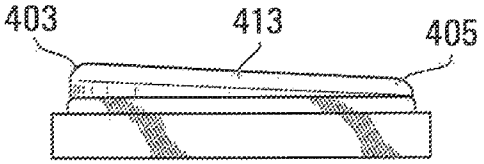
FIG. 9 is a right side elevation view of the part of FIG. 7.
Figure 12:
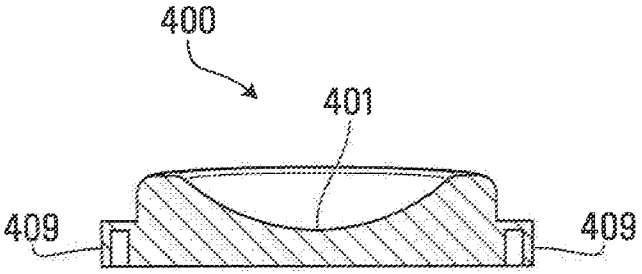
FIG. 12 is a cross section view at section IV-IV in FIG. 7.
Figure 11:
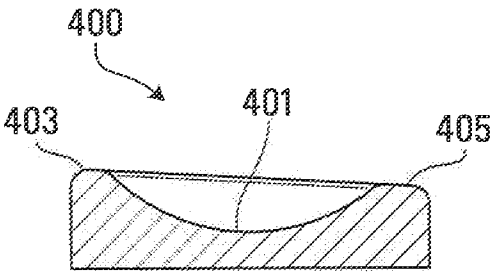
FIG. 11 is a cross section view at section III-III in FIG. 7.

FIG. 11 is a cross-section of the heel cup along the line shown in FIG. 7. Illustrated is an embodiment where curved side wall 403 is higher than curved side wall 405. FIG. 12 is a cross-section of the heel cup along the IV-IV line shown in FIG. 7 and it shows in cross-section the depression 401 and the tongues 409 that mate with grooves 205 of the support members 200.

Figure 13:
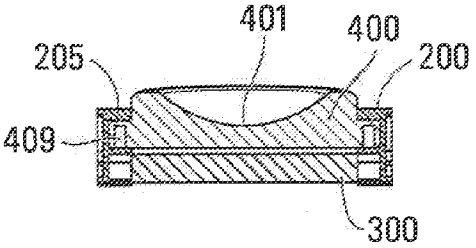
FIG. 13 is a cross section view of the device at section II-II in FIG. 1.

FIG. 13 shows a cross-section of the exercise device 100 along the II-II line shown in FIG. 1. Tongues 409 of the heel cup 400 may fit in grooves 205 of the support members 200. In the embodiment depicted, the tongues 409 may be integrally-formed right rectangular prisms extending from and attached to intermediate section 407 and plate 416/depression 401 of the heel cup 400. Grooves 205 may also be formed as right rectangular prism-shaped hollows integrally formed into the support members 200. The fit between the tongues 409 and the grooves 205 is close enough to minimize the movement of the heel cup in any direction other than longitudinal sliding free movement back and forth along the grooves 205 of the support members 200. The friction between the material of the tongues 409 and the material of the grooves 205 should be low enough to allow for the relatively free sliding movement of the heel cup 400 along the support members 200. Suitable low friction materials of grooves 205 and/or tongues 409 may include hard injection-moldable plastics, pexiglas, polished and varnished hard wood, and polished metals such as aluminum, alloys, and stainless steel.

Figure 14:
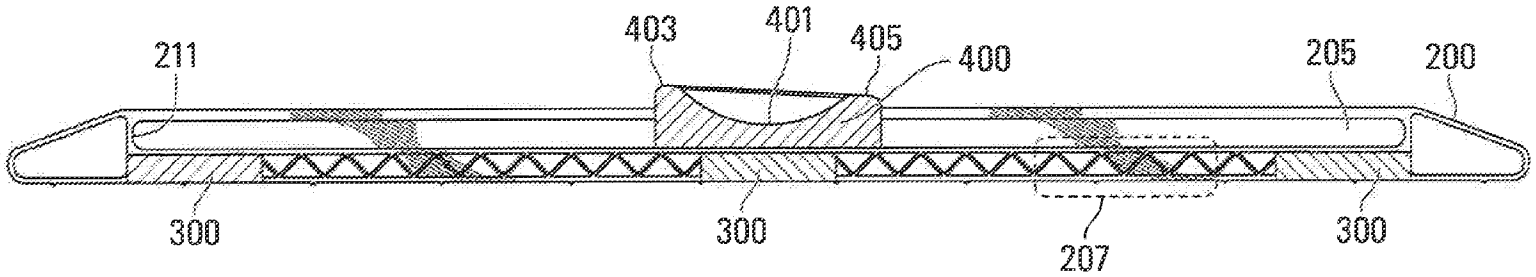
FIG. 14 is a cross section view of the device at section I-I in FIG. 1.

FIG. 14 shows a cross-section of the exercise device 100 along section I-I shown in FIG. 1. FIG. 14 shows an embodiment where the lip 413 of the heel cup's depression 401 has a higher side wall 403 and a lower side wall 405. In operation, heel cup 400 slides back and forth along the grooves 205, but is prevented from sliding out of the grooves by groove ends 211. The truss 207 provides a low-weight, high stiffness construction for the support members 200. In particular, the truss 207 provides support and added stiffness underneath the bottom surface plates of grooves 205 which may be subjected to the weight of the foot or leg during the operation of the exercise device 100 when the patient's heel is placed in the heel cup 400. The weight of the foot or leg would be transmitted to the depression 401 of the heel cup, which in turn would transmit the weight to the tongues 409 of the heel cup, which in turn are in contact with and transmit the weight to the bottom plates of the grooves 205.

Figure 15:
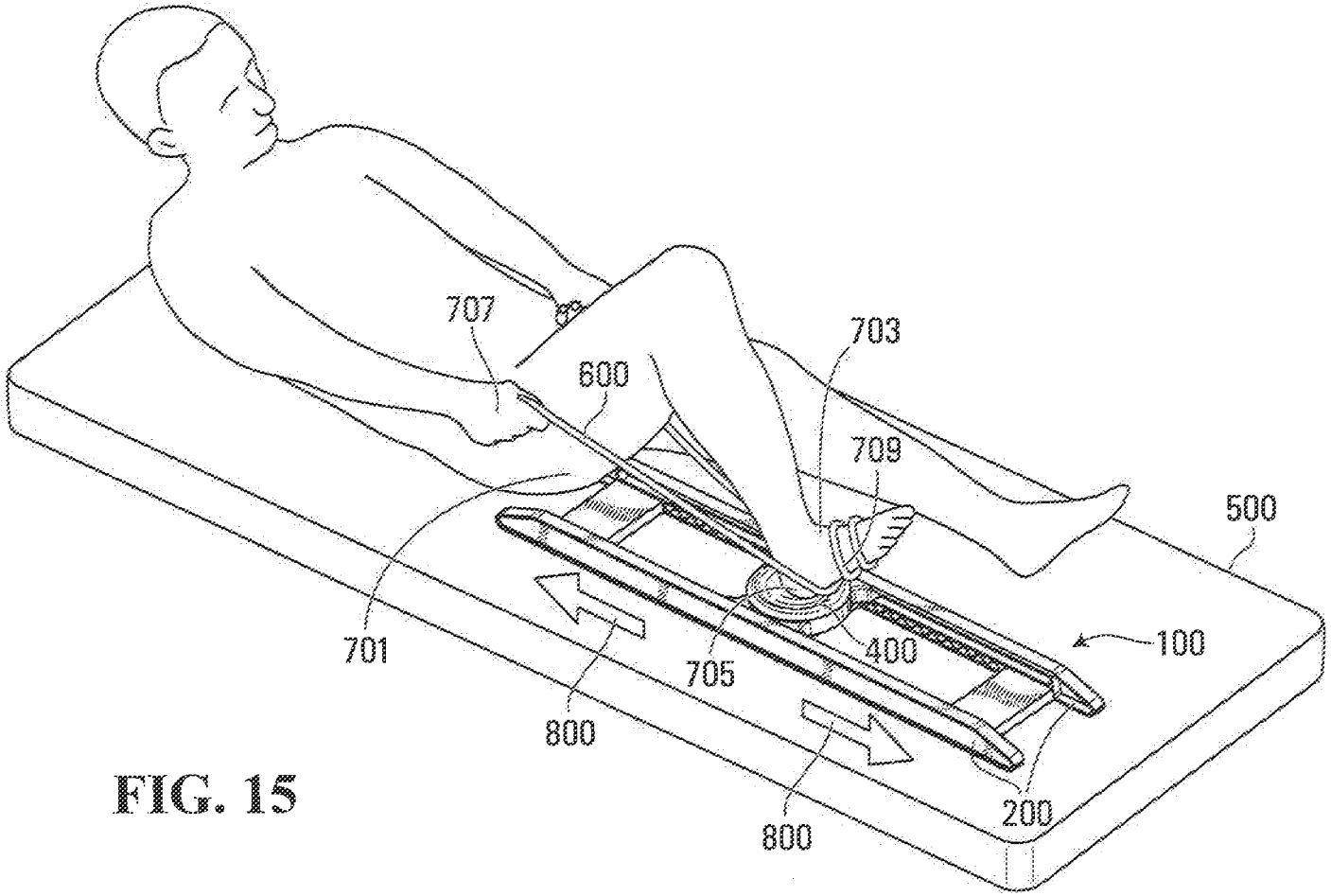
FIGS. 15 and 16 show the device being used in one example mode of operation.

FIG. 15 shows an example method of exercising using the exercise device 100. In this method the user (who may be a patient recovering from some kind of hip and/or leg injury) may lay on a platform 500, which may be a bed, a floor, or any other flat surface that may be horizontally oriented in space or at a moderate angle. The exercise device is also placed on platform 500, and one end of the exercise device 100 is placed underneath the patient's thigh 701. The exercise device 100 is aligned parallel to the patient's leg. The heel 705 of the patient's foot 703 is placed in depression 401 of the heel cup 400. The foot 703 and the heel cup 400 are then slid back and forth along the exercise device in the direction of arrows 800. Optionally, the patient may assist the movement of the foot using the patient's upper body strength. In one embodiment, the foot 703 is tethered to the patient's hands 707 using a rope 600, or any other elongated tethering means such as a strap, ribbon, chain, or cloth. In one embodiment, the rope 600 is wrapped at least once around the foot's instep 709 and the free ends of the rope 600 are held in the patient's hands 707. This enables the patient to assist the movement of the foot 703 along the support members 200 by pulling on the rope 600. The sliding back and forth exercise can be repeated as needed. The repetitions may be grouped in sets, with breaks in between the sets.

Figure 16:
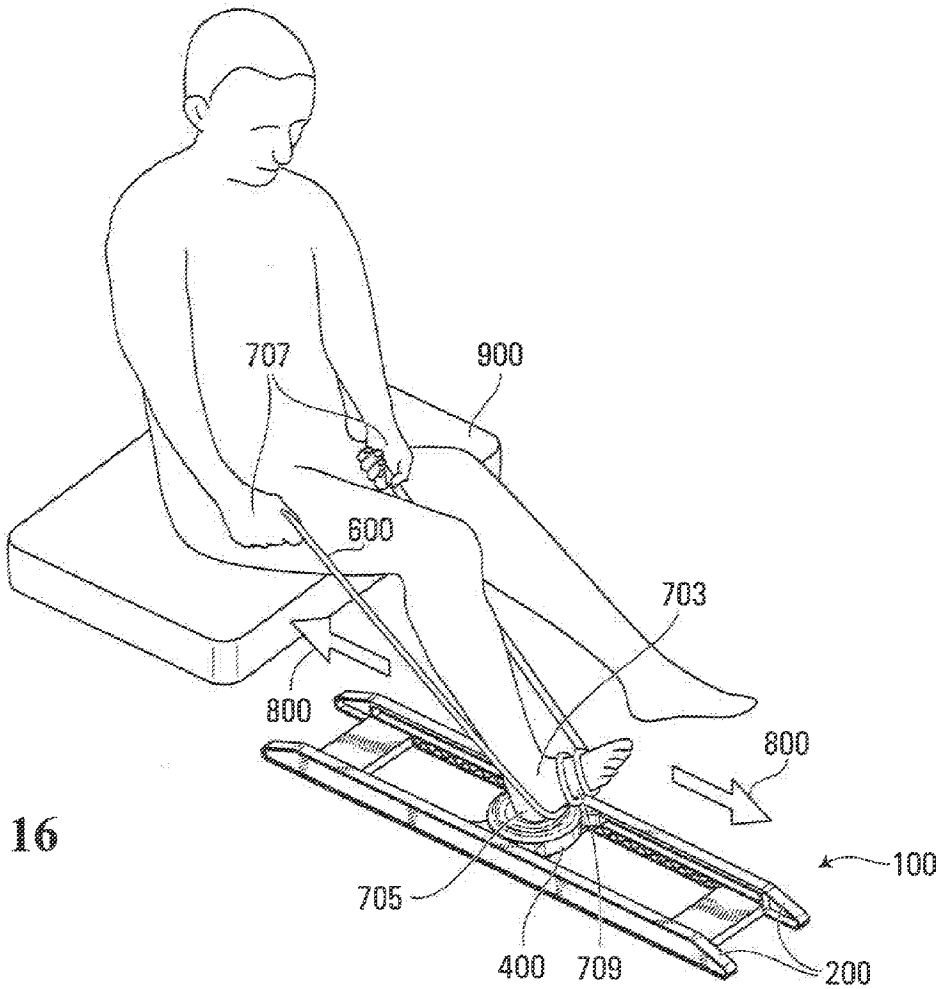

FIG. 16 shows a second method of exercising using the exercise device 100. In this method the patient may sit on a platform 900 elevated from the floor. The patient may sit on a chair, side of a bed, or any other elevated platform. The exercise device 100 is placed on the floor and aligned parallel to the patient's leg. The heel 705 of the patient's foot 703 is placed in depression 401 of the heel cup 400. The foot 703 and the heel cup 400 are then slid back and forth along the exercise device in the direction of arrows 800. Optionally, the patient may assist the movement of the foot using the patient's upper body strength. In one embodiment, the foot 703 is tethered to the patient's hands 707 using a rope 600, or any other elongated tethering means such as a strap, ribbon, chain, or cloth. In one embodiment, the rope 600 is wrapped at least once around the foot's instep 709 and the free ends of the rope 600 are held in the patient's hands 707. This enables the patient to assist the movement of the foot 703 along the support members 200 by pulling on the rope 600. The sliding back and forth exercise can be repeated as needed. The repetitions may be grouped in sets, with breaks in between the sets.

Figure 17:
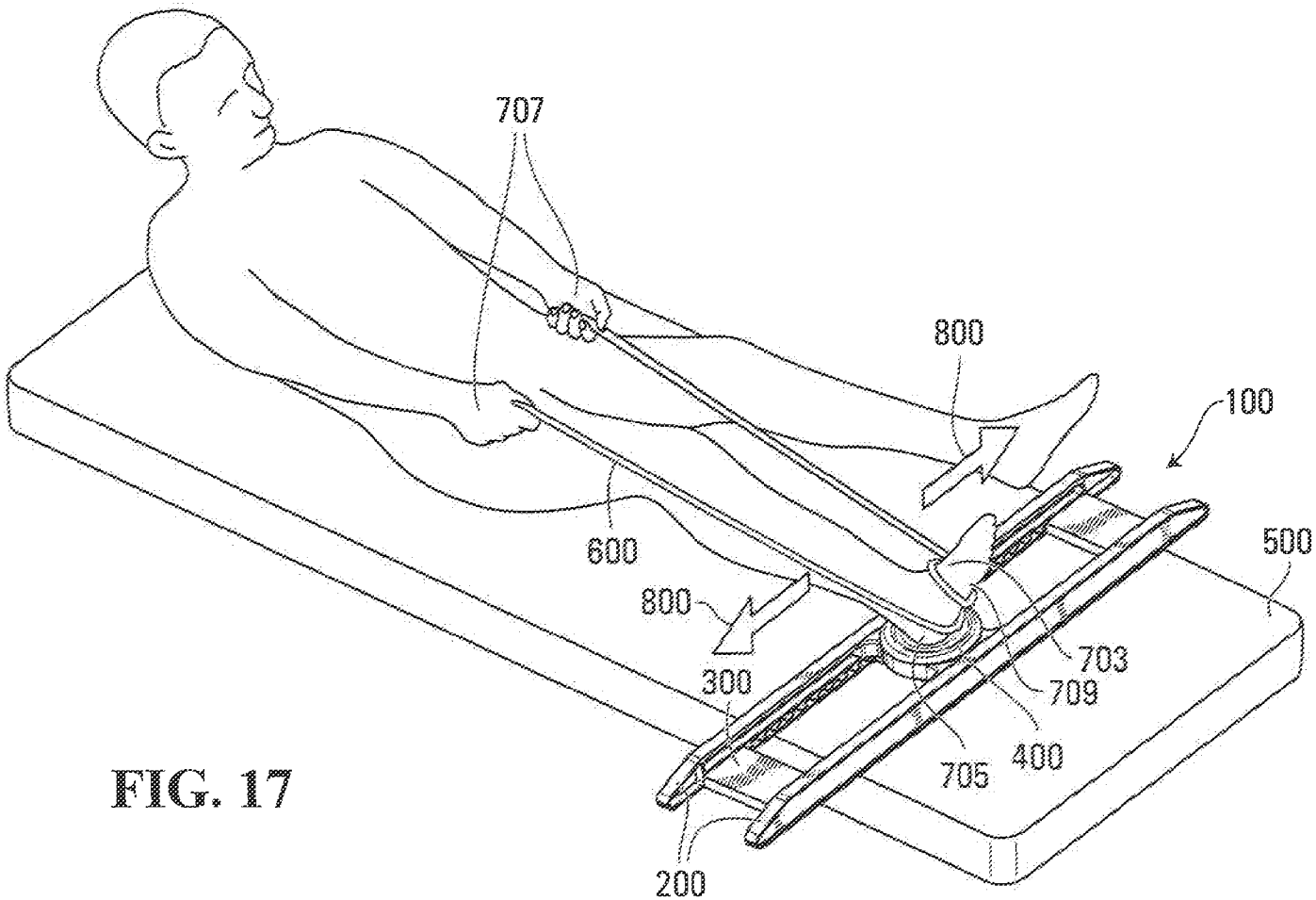
FIG. 17 shows the device being used in another example mode of operation.

FIG. 17 shows a third method of exercising using the exercise device 100. In this method the patient may lay on a platform 500, which may be a bed, a floor, or any other flat surface. The exercise device 100 is also placed on platform 500, and is positioned near the patient's foot 703. The exercise device 100 is aligned perpendicular to the patient's body. The heel 705 of the patient's foot 703 is placed in depression 401 of the heel cup 400. The foot 703 and the heel cup 400 are then slid side to side along the exercise device 100 in the direction of arrows 800. Optionally, the patient may assist the movement of the foot using the patient's upper body strength. In one embodiment, the foot 703 is tethered to the patient's hands 707 using a rope 600, or any other elongated tethering means such as a strap, ribbon, chain, or cloth. In one embodiment, the rope 600 is wrapped at least once around the foot's instep 709 and the free ends of the rope 600 are held in the patient's hands 707. This enables the patient to assist the movement of the foot 703 along the support members 200 by pulling on the rope 600 and moving the foot 703 from side to side. The sliding side to side exercise can be repeated as needed. The repetitions may be grouped in sets, with breaks in between the sets.

Figure 18:
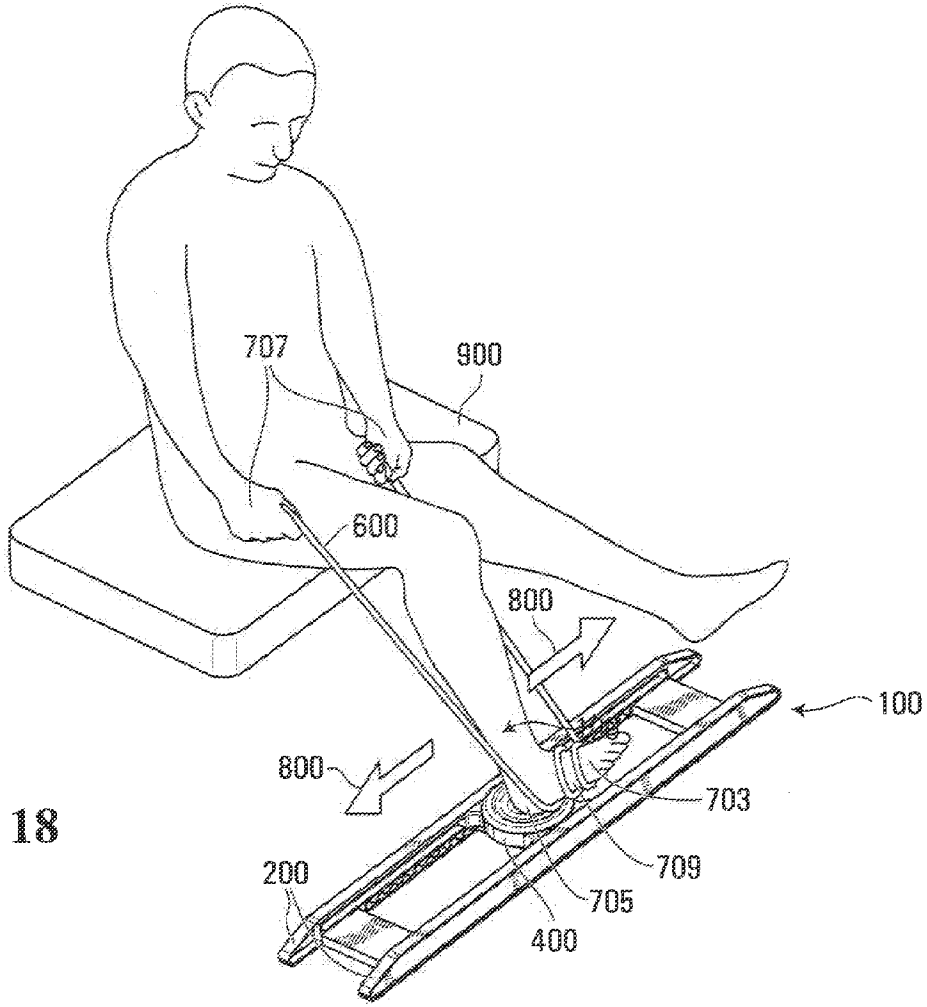
FIG. 18 shows the device being used in another example mode of operation.

FIG. 18 shows a fourth example method of exercising using the exercise device 100. In this method the patient may sit on a platform 900 elevated from the floor. The patient may sit on a chair, side of a bed, or any other elevated platform. The exercise device 100 is placed on the floor near the patient's foot 703, and is aligned perpendicular to the patient's body. The heel 705 of the patient's foot 703 is placed in depression 401 of the heel cup 400. The foot 703 and the heel cup 400 are then slid side to side along the exercise device 100 in the direction of arrows 800. Optionally, the patient may assist the movement of the foot using the patient's upper body strength. In one embodiment, the foot 703 is tethered to the patient's hands 707 using a rope 600, or any other elongated tethering means such as a strap, ribbon, chain, or cloth. In one embodiment, the rope 600 is wrapped at least once around the foot's instep 709 and the free ends of the rope 600 are held in the patient's hands 707. This enables the patient to assist the movement of the foot 703 along the support members 200 by pulling on the rope 600 and moving the foot 703 from side to side. The sliding side to side exercise can be repeated as needed. The repetitions may be grouped in sets, with breaks in between the sets.

It should be noted that in FIGS. 17 and 18, the heel will generally be rotating around a pivot located at the user's hip.

It will be appreciated that to better accommodate a rotational movement, the support members could be reconfigured to provide for an arc configuration with one support member defining an outer curved member and another a nested inner support member. The heel cup would also have to be modified to accommodate sliding movement in curved grooves.

Use of this exercise device can improve any individual's fitness and also can help in the rehabilitation of person's recovering from injuries and/or surgery on their legs/feet/hips.

After knee or hip surgery, the muscles surrounding the joint become weaker. The EZ-MEND Knee and Hip Rehabilitation Device 100 may be used to help build stronger muscles, restore your range of motion and at the same time develop the muscles around the joint.

Using device 100 can help to increase circulation, prevent blood clots, strengthen muscles, create ankle pumping, diminish postoperative pain and reduce leg swelling. Device 100 can be used to help restore mobility and strength to promote getting back to everyday activities and a full recovery. The device can be used after knee surgery, hip surgery, sports injuries, and can be used by nursing home patients desiring improved muscle tone, improved mobility and to help eliminate stiffness.

After arthroscopic knee surgery, it is important to start exercising a patient's knee immediately to help restore full range of motion and strength. Exercise device 100 can be a substantially non-weight-bearing exercise device.

A further method of use of the device is as follows:

1) Place one end of the device 100 under the thigh parallel to a user's leg while lying in a prone position on the bed.
2) Wrap the rope twice around the instep of the foot. Grasp one end of the rope in each hand and place your heel into the cup of the device.
3) Using the rope, slowly pull the leg along the support members towards the user's chest. Hold the knee in this bent position for 5 to 10 seconds and then straighten. Repeat this procedure at a user's own pace, resting when fatigued.
4) Alternatively, for hip surgery recovery, another procedure is to lie in a prone position on the bed while keeping the rope wrapped around the foot. Straighten the leg while positioning the device laterally to the body and placing the heel in the cup. Slide the leg from side to side.

After a period of time, a user may perform both procedures while sitting on the side of the bed or on a chair and placing the device on the floor. A Doctor or Physiotherapist may recommend that you repeat these procedures 20 to 30 minutes at a time, 2 or 3 times a day. Icing before therapy may reduce swelling and pain.

Initially, exercises may be uncomfortable, but with consistent use, the device may lessen recovery time and improve the overall quality of life. It is recommended that a medical care professional such as a doctor or physiotherapist monitor the progress.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. An exercise device, comprising:

(a) first and second elongated, longitudinally extending support members, each comprising an integrally formed elongated, longitudinally extending sliding surface;

(b) at least one laterally extending brace member holding said first and second support members in a generally parallel spaced apart relation to each other;

(c) a heel support device being generally located and extending between said first and second support members, said heel support device having a generally upwardly directed surface configured and operable to receive and support a heel of a user's foot for longitudinal sliding movement of said heel support device between said first and second support devices;

said first and second elongated support members and said heel support device being configured with a sliding connection, said sliding connection operable such that in operation said heel support device is slidably supported for sliding longitudinal movement on said sliding surface of said first elongated support member at a first side of said heel support device by said sliding surface of said first support member and is slidably supported for sliding longitudinal movement on said sliding surface of said second elongated support member at a second side of said heel support device by said sliding surface of said second support member for sliding longitudinal movement relative to first and second said support members, wherein during operation substantially all weight exerted by a heel of a user's foot on said heel support device is carried on said sliding surfaces; and wherein:

said sliding connection comprises: (i) a pair of elongated sliding grooves on said first and second elongated support members providing said elongated sliding surfaces and (ii) first and second sliding protrusion elements of said heel support device received respectively in each of said respective elongated sliding grooves of said first and second elongated support members.

2. An exercise device as claimed in claim 1 wherein said heel support device comprises a heel cup.

3. An exercise device as claimed in claim 1 or claim 2 wherein each of said support members has an end portion and wherein said end portion is tapered.

4. An exercise device as claimed in claim 1 or claim 2, wherein each of said first and second support members has a strengthening structure reinforcing said sliding surface.

5. An exercise device comprising:

(a) first and second elongated, longitudinally extending support members, each comprising an elongated, longitudinally extending sliding surface;

(b) at least one laterally extending holding said first and second support members in a generally parallel spaced apart relation to each other;

(c) a heel support device being generally located and extending between said first and second support members, said heel support device having a generally upwardly directed surface configured and operable to receive and support a heel of a user's foot for longitudinal sliding movement of said heel support device between said first and second support devices, said first and second elongated support members and said heel support device being configured with a sliding connection, said sliding connection operable such that in operation said heel support device is slidably supported for sliding longitudinal movement on said sliding surface of said first elongated support member at a first side of said heel support device by said sliding surface of said first support member and is slidably supported for sliding longitudinal movement on said sliding surface of said second elongated support member at a second side of said heel support device by said sliding surface of said second support member for sliding longitudinal movement relative to first and second said support members, wherein during operation substantially all weight exerted by a heel of a user's foot on said heel support device is carried on said sliding surfaces;

wherein each of said first and second support members has a strengthening structure reinforcing said respective sliding surface;

wherein each said strengthening structure comprises (a) an elongated support slot positioned below said respective sliding surface and (b) an elongated structural support device within said respective elongated support slot.

6. An exercise device as claimed claim 2 wherein said heel cup has a generally upwardly directed surface configured as a depression.

7. An exercise device as claimed in claim 6, wherein the depression has a circumferential opening defined by a lip, and wherein the lip is rounded or beveled.

8. An exercise device of claim 7, wherein the depression has a circumferential opening lip, and the lip is made from natural polyisoprene, polybutadiene, butyl rubber, silicone rubber, or ethylene propylene rubber.

9. An exercise device as claimed in claim 1 wherein the heel support device is made from natural polyisoprene, polybutadiene, butyl rubber, silicone rubber, or Ethylene Propylene Rubber.

10. An exercise device as claimed in claim 1, wherein each of said support members, including said sliding surfaces, is formed as a single contiguous piece using a plastic molding process.

11. An exercise device as claimed in claim 10, wherein said heel support device is formed as a single contiguous piece using a plastic molding process.

12. An exercise device as claimed in claim 10 or 11, wherein said support members are formed from one of: Nylenium 2800ST S, polycarbonates, nylon, acrylics or acrylonitrile butadiene styrene.

13. An exercise device as claimed in claim 12, wherein said heel support device and said support members are formed from the same material.

14. An exercise device as claimed claim 1 or claim 2 or claim 5, wherein said support members, and said at least one brace member, are each made from a plastic formed by injection molding.

15. An exercise device as claimed in claim 5 wherein said structural support device comprises an elongated truss.

16. An exercise device as claimed in claim 15 wherein each said elongated truss is integrally formed as part of the first and second support members.

17. An exercise device, comprising:

first and second elongated support members each comprising an integrally formed sliding surface;

first and second transversely extending brace members for holding said first and second support members in a spaced apart relation to each other;

a heel support device being disposed between said first and second support members and being slidably supported at a first side by said sliding surface of said first support member and at a second side by said sliding surface of said second support member for sliding longitudinal movement relative to said first and second support members, said heel support device having a generally upwardly directed surface configured and operable to receive and support a heel of a user's foot for longitudinal sliding movement of said heel support device wherein substantially all weight exerted by a heel on said upwardly directed surface of said heel support device is carried on said sliding surfaces;

wherein each of said first and second support members has a strengthening structure reinforcing said respective sliding surface;

wherein each said strengthening structure comprises (a) an elongated support slot positioned below said respective sliding surface and (b) an elongated structural support device within said respective elongated support slot.

18. An exercise device as claimed in claim 17, wherein each of said support members, including said sliding surfaces, is formed as a single contiguous piece using a plastic molding process.

19. An exercise device as claimed in claim 18, wherein said heel support device is formed as a single contiguous piece using a plastic molding process.

20. An exercise device as claimed in claim 18 or 19, wherein said support members are formed from one of: Nylenium 2800ST S, polycarbonates, nylon, acrylics or acrylonitrile butadiene styrene.

21. An exercise device as claimed in claim 20, wherein said heel support device and said support members are formed from the same material.

22. An exercise device comprising:

(a) first and second elongated, longitudinally extending support members, each comprising an integrally formed elongated, longitudinally extending sliding surface;

(b) at least one laterally extending brace member maintaining said first and second support members in a generally parallel spaced apart relation to each other;

(c) a heel support device being generally located and extending between said first and second support members;

said first and second elongated support members and said heel support device being configured with a sliding connection, said sliding connection operable such that said heel support device is slidably supported for sliding longitudinal movement on said sliding surface of said first elongated support member at a first side of said heel support device by said sliding surface of said first support member and is slidably supported for sliding longitudinal movement on said sliding surface of said second elongated support member at a second side of said heel support device by said sliding surface of said second support member for sliding longitudinal movement relative to first and second said support members, wherein during operation substantially all weight exerted on said heel support device is carried on said sliding surfaces;

and wherein each of said first and second support members has a strengthening structure reinforcing said respective sliding surface, and wherein each said strengthening structure comprises (a) an elongated support slot positioned below said sliding surface; and (b) an elongated structural support device within said elongated support slot.

23. An exercise device as claimed in claim 22 wherein said strengthening structure comprises an elongated truss.

24. An exercise device as claimed in claim 23 wherein each said elongated truss is integrally formed as part of the first and second support members.

* * * * *